United States Patent [19]

Renn

[11] 4,157,831

[45] Jun. 12, 1979

[54] COMPACT GOLF COURSE

[76] Inventor: Charlie W. Renn, 6040 Old Valley School Rd., Kernersville, N.C. 27284

[21] Appl. No.: 840,726

[22] Filed: Oct. 11, 1977

Related U.S. Application Data

[63] Continuation-in-part of Ser. No. 672,120, Mar. 31, 1976, abandoned.

[51] Int. Cl.[2] ..... A63B 69/36

[52] U.S. Cl. ..... 273/176 AB

[58] Field of Search ..... 273/176 AB, 176 R, 176 A, 273/176 G, 176 H, 176 B, 176 D

[56] References Cited

U.S. PATENT DOCUMENTS

| | | | |
|---|---|---|---|
| 2,550,480 | 4/1951 | Hubbard | 273/176 AB X |
| 3,156,470 | 11/1964 | Newkirk | 273/176 AB |
| 3,719,361 | 3/1973 | Rotolo | 273/176 AB |

OTHER PUBLICATIONS

"Golf World", Jul. 20, 1962, p. 15.
"Golf Digest", Nov. 1959, vol. 10, No. 9, p. 63.

*Primary Examiner*—George J. Marlo
*Attorney, Agent, or Firm*—Jay M. Cantor

[57] ABSTRACT

Outdoor golf course layouts are described for providing a complete eighteen hole course in a minimum area. The golf course layouts are characterized by a substantially polygonal outside course perimeter utilizing straight lines from tee area to hole. The preferred embodiments are in the figure of a hexagon. Fairways of different holes will intersect other fairways in the embodiments. It is also contemplated that doglegs can be provided in the fairways for each or some of the holes rather than the straight line configuration from tee to hole, still substantially utilizing the hexagonal outer shape of the course. Each of the apices of the hexagon will include, in the general surrounding area, the holes or green and tee areas for a plurality of the holes in the course. In addition, there will be one area located in the interior of the hexagon which will provide in the general area thereof tee and hole or green locations for a plurality of the holes of the layouts.

8 Claims, 7 Drawing Figures

S
A
B
C
D
E
F
1
2
3
4
5
6
7
8
9
10
11
12
13
14
15
16
17
18

S
A
B
C
D
E
F
1
2
3
4
5
6
7
8
9
10
11
12
13
14
15
16
17
18

COMPACT GOLF COURSE

PRIOR APPLICATION

This is a continuation-in-part of my prior application Ser. No. 672,120, filed Mar. 31, 1976, now abandoned.

BACKGROUND OF THE INVENTION

This invention relates to a compact golf course layout for providing a complete eighteen hole golf course in a minimal area and, more specifically, to a golf course layout wherein all tee and hole or green areas are located at six apices on the perimeter of a hexagon and one area in the interior of the hexagon.

In view of the increasingly high cost of land and its increasing unavailability in large blocks in more densely populated areas, golf courses have either been forced to move far beyond the population centers or, alternatively, where only limited space is available, the number of holes in the course has been restricted to far below the normal eighteen holes.

BRIEF DESCRIPTION OF THE INVENTION

In accordance with the present invention, the above problems are substantially overcome and there is provided a complete eighteen hole golf course capable of being laid out in a restricted area. Briefly, the above is accomplished by providing areas at the six apices of a hexagon wherein a plurality of hole or green and tee locations for the holes are located. In addition, there is provided a single area in the interior of the hexagon wherein tee and hole or green areas are provided. The fairways are then laid out from these seven areas in appropriate manner whereby the hole or green area for a first hole is also the teeing off area for the succeeding hole. Of course, the green and tee areas at the seven locations can be offset or spaced from each other and may or may not overlay, as desired. The fairways provided thereby will overlap, however, there will also be provided the full eighteen hole complement with the holes following each other in a continuous pattern.

OBJECTS OF THE INVENTION

It is therefore an object of this invention to provide a complete eighteen hole golf source layout which is capable of being laid out in a restricted area relative to prior art golf courses of substantially the same length.

It is a further object of this invention to provide a golf course layout wherein the perimeter of the course is formed substantially in the shape of a hexagon with the hexagon apices and a single area in the interior of the hexagon forming the areas in which all of the greens and tee areas are located.

Figure 1:
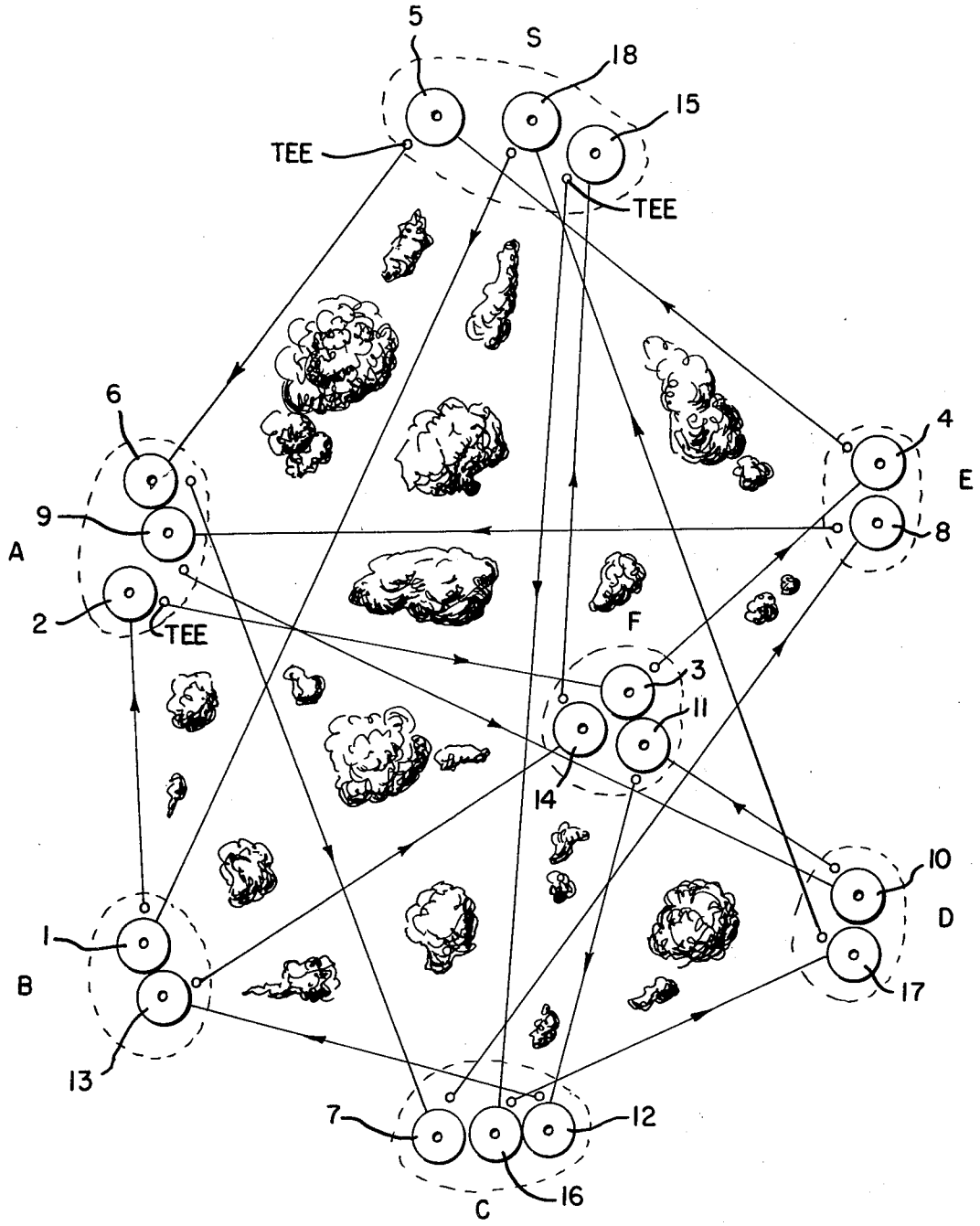
Figure 2:
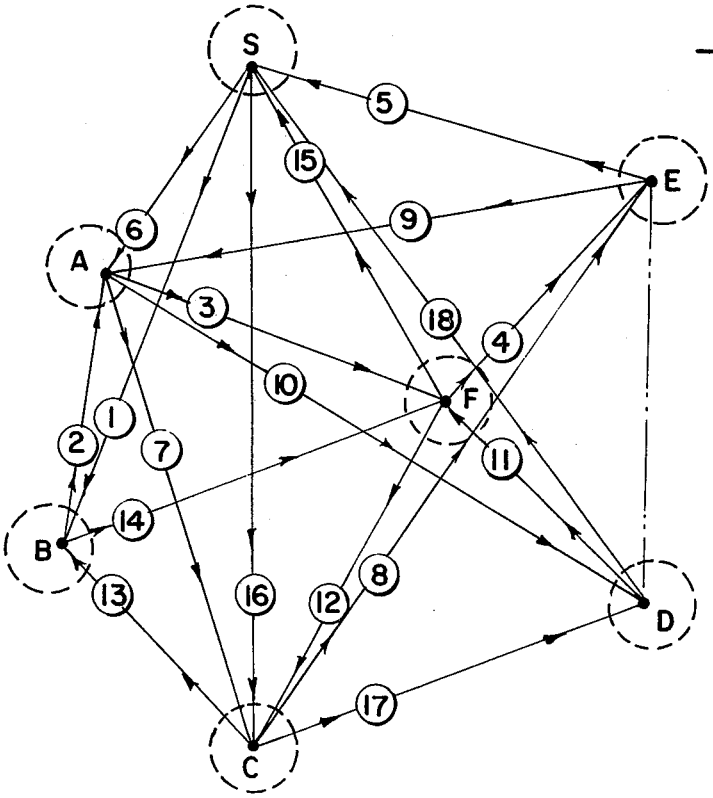
Figure 3:
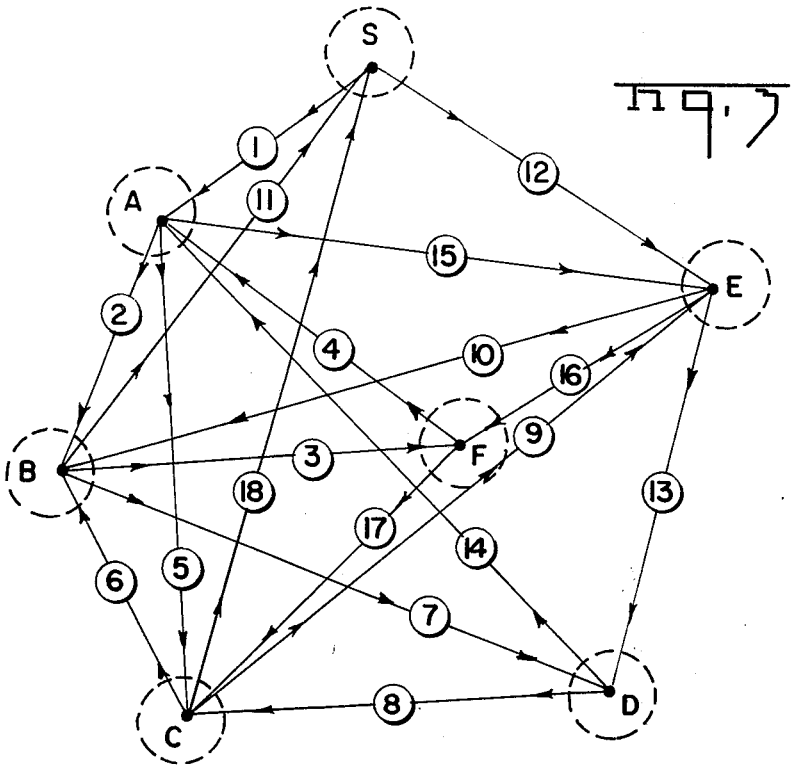
Figure 4:
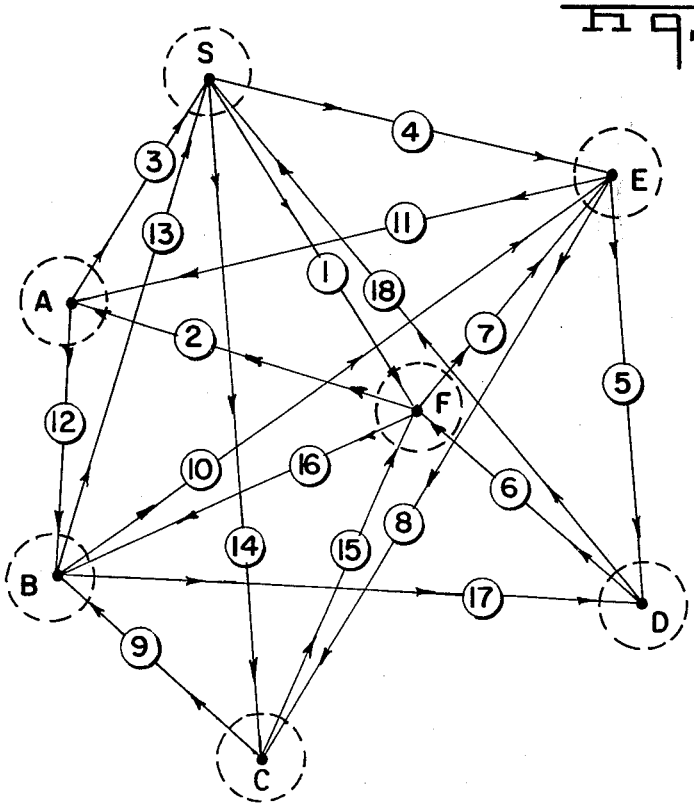
Figure 5:
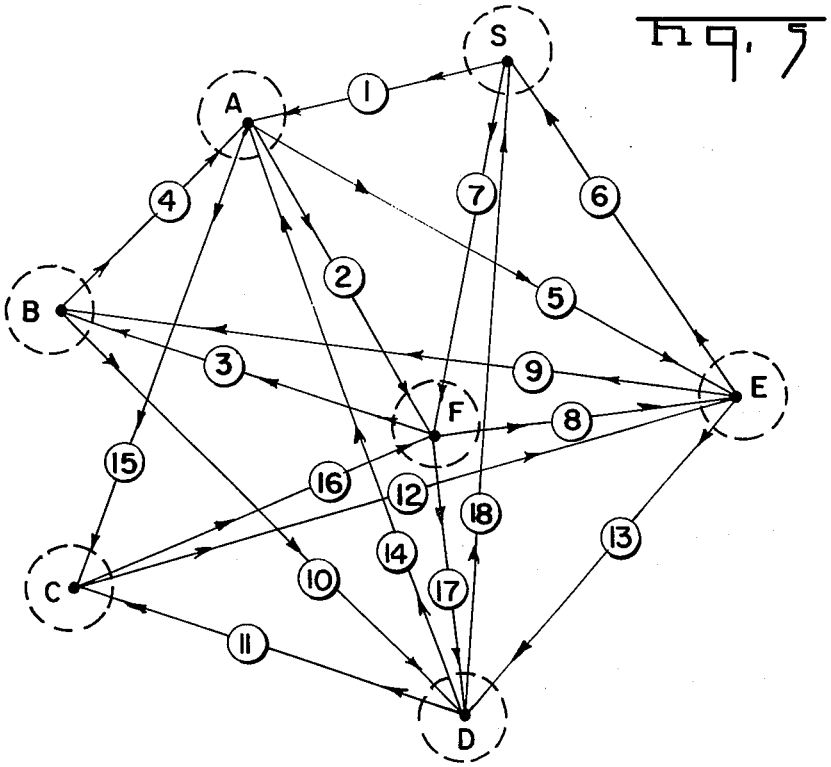
Figure 6:
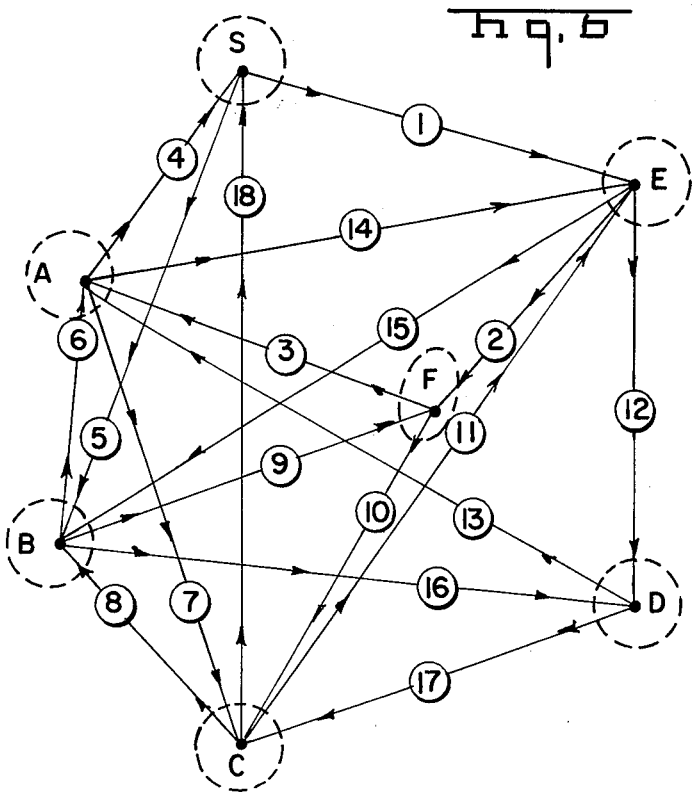

The above objects and still further objects of the invention will immediately become apparent to those skilled in the art after consideration of the following preferred embodiments thereof, which are provided by way of example and not by way of limitation where:

FIG. 1 is a schematic diagram of a first layout of a golf course in accordance with the present invention; and FIGS. 2 through 7 each depict a distinct embodiment of a golf course layout in accordance with the present invention, the area within the dotted lines in each Figure being comprised of one or more green and tee regions as in FIG. 1.

DESCRIPTION OF THE SPECIFIC PREFERRED EMBODIMENTS

Referring now to the FIGURES, there is shown in each of the figures a golf course layout wherein the numbers in the fairways for each of the holes corresponds to the number of that particular hole. Eighteen holes are shown. The golf course layout is preferably provided within the perimeter of a substantial hexagon of regular or irregular shape, each apex of the hexagon S, A, B, C, D and E schematically designating areas wherein the green areas of certain holes and the tee areas of the succeeding numbered holes would be located, it being understood that the various green and tee areas may be offset from each other and not necessarily positioned one atop the other as could be inferred from the schematic drawings. It should be understood that the letters S, A, B, C, D, E AND F generally designate larger areas encompassed by the do ted lines, for location of the tee and green areas of the various holes commencing or terminating in the general area. As can be seen from the layouts, the green or hole area of a particular hole is in the same area as the tee area for the succeedingly numbered hole. It is also seen that a plurality of holes can have green areas or tee areas at the same apex of the hexagon. The straight lines shown in the Figures symbolize the fairways and the arrows indicate the direction in which a ball is to be hit from a tee adjacent one numbered green region to the next numbered hole or green region. In addition, there is the one area F in the interior of the hexagon which designates a general area wherein green and tee areas are located. It is also readily apparent that fairways for particular greens will intersect one or more fairways of other numbered holes in the layout. By utilizing the arrangement of FIG. 1, a seventy-two hundred thirteen yard golf course has been designed within a sixty-five acre rectangular area. The embodiment of FIG. 2 has been designed with a sixty-one hundred thirty yard course in a rectangular area of forty-eight acres. Similarly, the remaining embodiments can be provided in restricted areas with the area size being dependent on the length of the golf course. Although each hole or green and tee region is not individually shown in FIGS. 2 through 7 as it is in FIG. 1, it should be understood that they are nevertheless present in the same way within each of the areas encompassed by the dotted lines.

Though the golf course schematic diagrams are shown to have straight fairways, it should also be understood that the fairways can have doglegs or other shapes, it merely being necessary that the tee area be at one of the areas labeled S, A, B, C, D, E and F and that the green areas for the holes also be located in these lettered areas. Such a layout with doglegs and the like is more specifically shown in FIG. 7.

Figure 7:
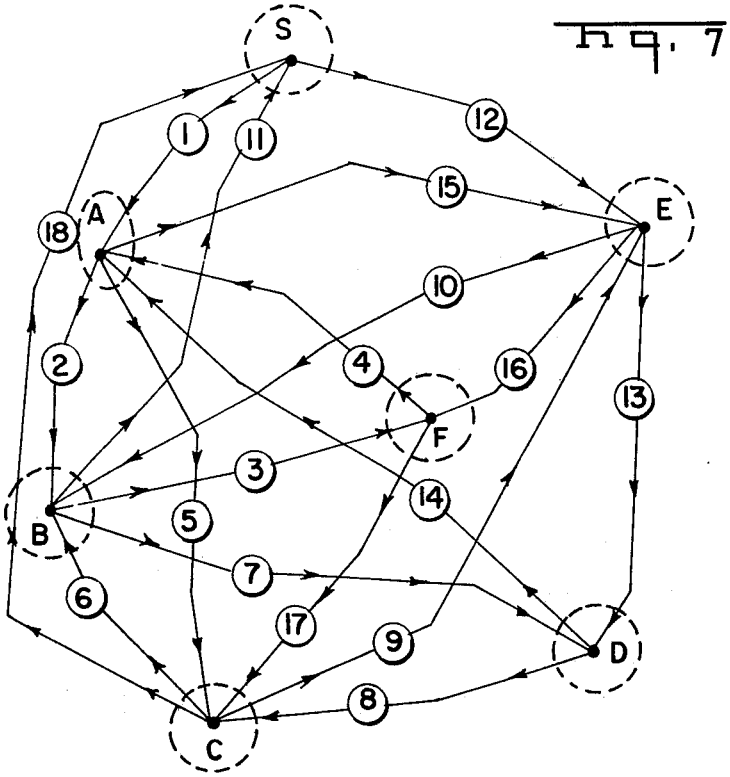

As is apparent from FIG. 7, it is conceivable that some or all of one or more fairways can extend beyond the area of the hexagon in the event space permits. However, the fundamental concept of having all green and tee areas disposed in six areas which are located at the apices of a hexagon and a seventh area located at the interior of the hexagon is maintained. It should be noted from FIG. 1 that the adjacent green or hole regions wihtin each area are not separated by a fairway but are closely clustered together. The same is true of the hole or green regions within the areas encompassed by the dotted lines in FIGS. 2–7.

It can be seen that in accordance with the present invention, there is provided a complete eighteen hole golf course layout of any desired course length which can be placed in a very restricted area relative to prior art golf courses.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A golf course which comprises (a) a plurality of perimeter areas spaced from each other and so located that straight lines joining them form the outline of a polygon, a plurality of fairways extending away from each of said areas, each area being comprised of a plurality of green regions closely clustered together, each green region including means bearing a number for indicating a predetermined numbered golf course hole and an adjacent tee region for playing to the next numbered green region, the space between each said adjacent tee region and the next numbered green region comprising a fairway, and (b) a further area located at the interior of the polygon, said area being comprised of a plurality of numbered green regions and at least one adjacent tee region closely clustered together, (c) at least some of said fairways extending along the perimeter of said polygon, and some of said fairways extending across other ones of said fairways, and some of said green and tee regions being so numbered and located as to require a golfer playing the course to travel along the crossing fairways and along the fairways extending on the perimeter of said polygon in order to play some of said holes along the perimeter of said polygon, (d) a fairway extending between each said green and tee region of said further area and the green and tee regions of at least one of the areas located at the perimeter and some of said green and tee regions being so numbered and located as to require a golfer playing the course to travel a fairway to said further area in order to play a hole located in said further area.

2. A golf course layout as set forth in claim 1 wherein said polygon is a hexagon.

3. A golf course layout as set forth in claim 1 wherein at least one green and tee region in at least some of said areas are spaced from each other.

4. A golf course layout as set forth in claim 2 wherein at least one green and tee region in at least some of said areas are spaced from each other.

5. A golf course layout as set forth in claim 1 wherein at least one green and tee region in at least some of said areas overlap each other.

6. A golf course layout as set forth in claim 2 wherein at least one green and tee region in at least some of said areas overlap each other.

7. A golf course layout as set forth in claim 1 wherein said green and tee regions in each of said areas overlap each other.

8. A golf course layout as set forth in claim 2 wherein said green and tee regions in each of said areas overlap each other.

* * * * *